US012325065B2

(12) United States Patent
Takagi et al.

(10) Patent No.: US 12,325,065 B2
(45) Date of Patent: Jun. 10, 2025

(54) METHOD FOR MANUFACTURING METAL MATRIX COMPOSITE MATERIAL

(71) Applicant: ADVANCED COMPOSITE CORPORATION, Fuji (JP)

(72) Inventors: Yoshio Takagi, Fuji (JP); Hitoshi Kitamura, Fuji (JP); Shogo Ochiai, Fuji (JP)

(73) Assignee: ADVANCED COMPOSITE CORPORATION, Fuji (JP)

( * ) Notice: Subject to any disclaimer, the term of this patent is extended or adjusted under 35 U.S.C. 154(b) by 0 days.

(21) Appl. No.: 18/557,983

(22) PCT Filed: Dec. 23, 2022

(86) PCT No.: PCT/JP2022/047659
§ 371 (c)(1),
(2) Date: Oct. 30, 2023

(87) PCT Pub. No.: WO2023/136101
PCT Pub. Date: Jul. 20, 2023

(65) Prior Publication Data

US 2024/0216987 A1 Jul. 4, 2024

(30) Foreign Application Priority Data

Jan. 14, 2022 (JP) ..... 2022-004377

(51) Int. Cl.
*B22D 19/02* (2006.01)
*B22D 18/02* (2006.01)
(Continued)

(52) U.S. Cl.
CPC ..... *B22D 19/02* (2013.01); *B22D 18/02* (2013.01); *B22D 19/0081* (2013.01); *B22D 21/04* (2013.01)

(58) Field of Classification Search
CPC ..... B22D 18/02; B22D 21/04; B22D 19/00; B22D 19/0081; B22D 19/02; B22D 19/14
(Continued)

(56) References Cited

U.S. PATENT DOCUMENTS 4,712,600 A 12/1987 Hamajima et al.
5,503,122 A 4/1996 Ritland et al.

FOREIGN PATENT DOCUMENTS

JP 62-024853 2/1987
JP 08-501500 2/1996
(Continued)

OTHER PUBLICATIONS

Machine translation of JP 2000-336438 A (Year: 2000).*
(Continued)

*Primary Examiner* — Kevin P Kerns
(74) *Attorney, Agent, or Firm* — HSML P.C.

(57) ABSTRACT

A method for producing a metal matrix composite by compounding a matrix material and a reinforcing material. The metal matrix composite has a near-net shape with high dimensional accuracy and a high reinforcing material volume ratio (Vf %). The matrix material is a pure metal or an alloy, and the reinforcing material includes ceramic particles, graphite particles, and/or metal particles, and the reinforcing material is different from the matrix material. The method includes molding a reinforcing material-molded or filled body having a near-net shape and pores, in a metal mold having a cavity corresponding to the near-net shape, pre-heating the mold including the reinforcing material-molded or filled body, placing the mold in an outer shell metal mold, casting a molten matrix material into the pores of the reinforcing material-molded or filled body, thereby obtaining the metal matrix composite. The method uses the same mold throughout the entire process.

6 Claims, 4 Drawing Sheets

(51) Int. Cl.
*B22D 19/00* (2006.01)
*B22D 21/04* (2006.01)

(58) Field of Classification Search
USPC ..... 164/91, 97, 98, 120
See application file for complete search history.

(56) References Cited

FOREIGN PATENT DOCUMENTS

| | | |
|---|---|---|
| JP | 08-267217 | 10/1996 |
| JP | 10-180434 | 7/1998 |
| JP | 11-050173 | 2/1999 |
| JP | 2000-336438 | 12/2000 |
| JP | 2012-184493 | 9/2012 |
| JP | 2013-087307 | 5/2013 |
| JP | 2015-531688 | 11/2015 |

OTHER PUBLICATIONS

International Search Report, issued in the corresponding PCT application No. PCT/JP2022/047659, dated Jan. 31, 2023, 7 pages (including translation).

* cited by examiner

[Figure 1A]
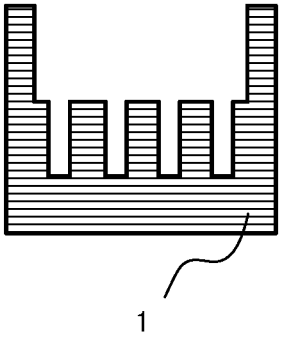
[Figure 1B]
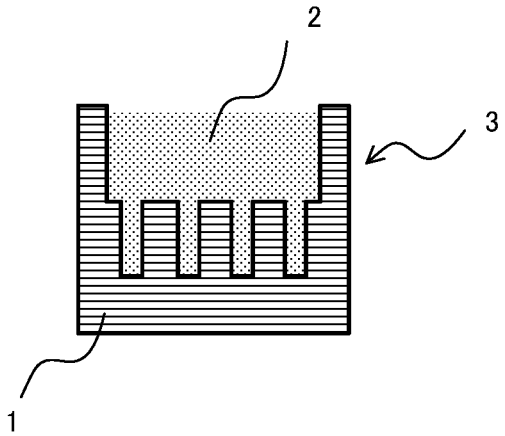
[Figure 1C]
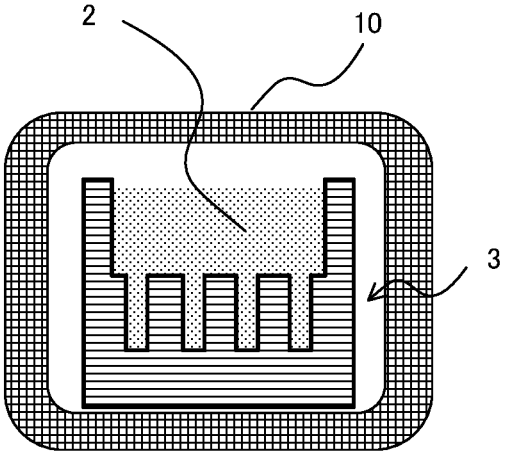

[Figure 1D]
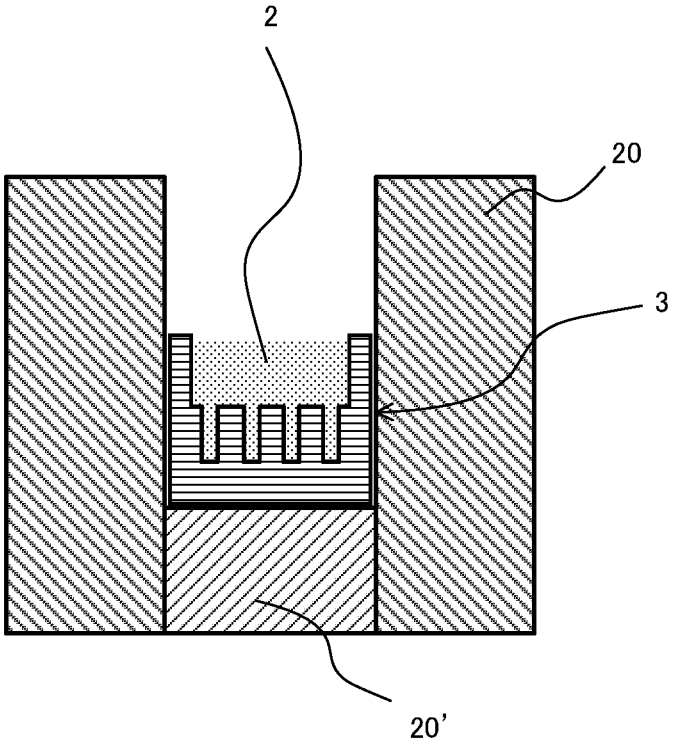
[Figure 2A]
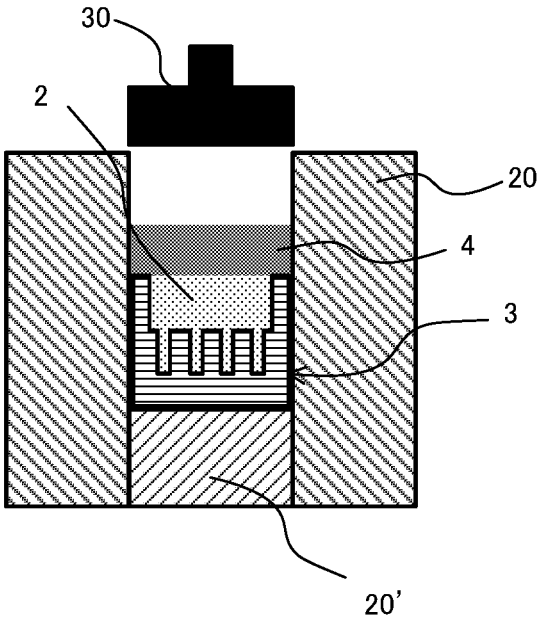

[Figure 2B]
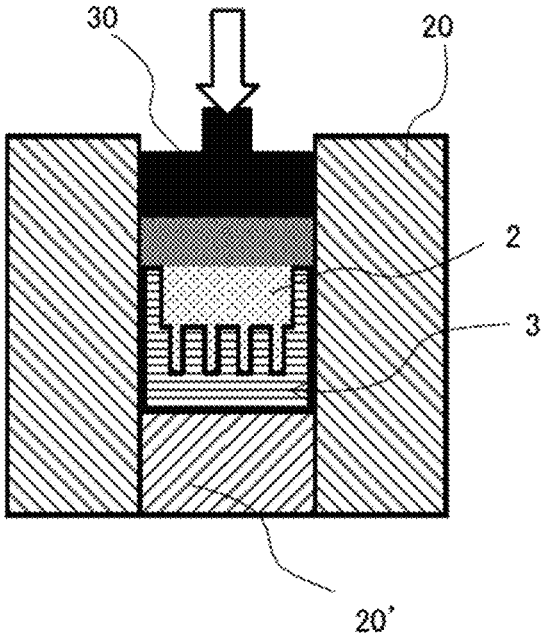
[Figure 2C]
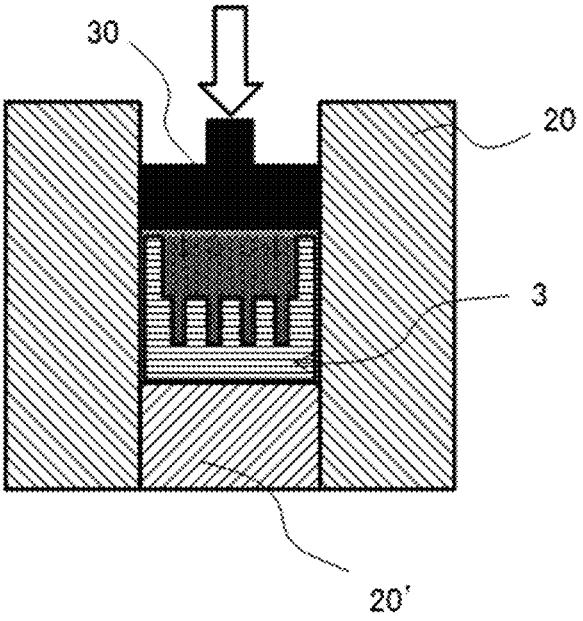

[Figure 3A]
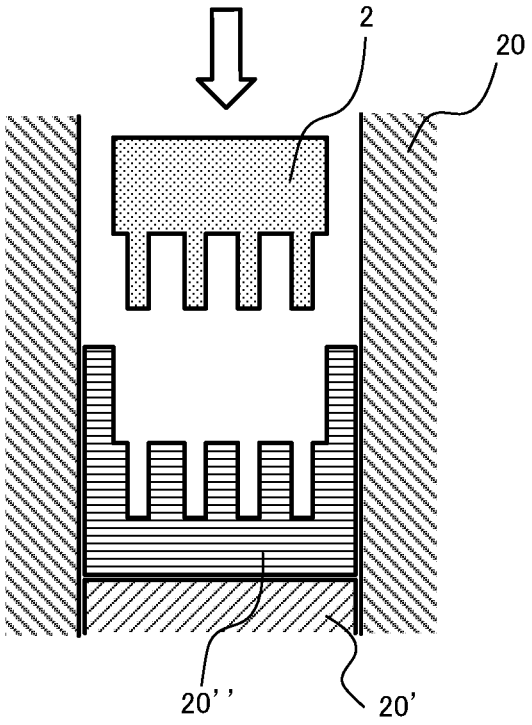
[Figure 3B]
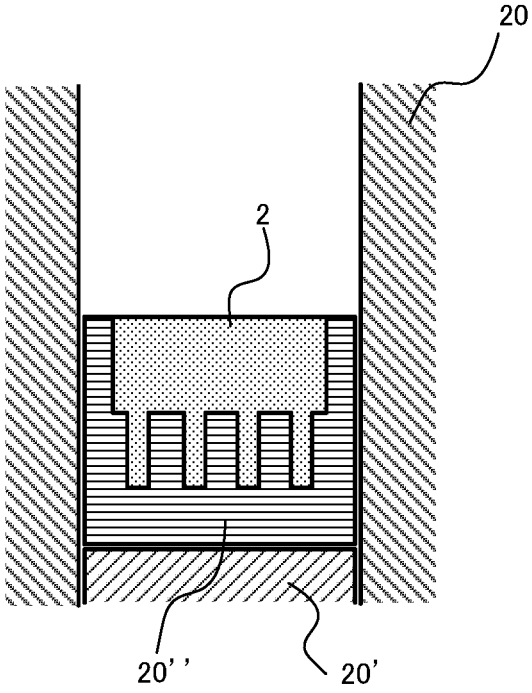

METHOD FOR MANUFACTURING METAL MATRIX COMPOSITE MATERIAL

TECHNICAL FIELD

The present invention relates to a method for producing a metal matrix composite and relates to a technique for producing a metal matrix composite, which makes it possible to easily obtain a metal matrix composite having a near-net shape of high dimensional accuracy and a high reinforcing material volume ratio (Vf %) by using the same metal mold in common in a series of steps. In more detail, the present invention relates to a technique for producing a metal matrix composite, wherein when a matrix material composed of a pure metal or an alloy and a reinforcing material are compounded using a porous reinforcing material-molded body or filled body composed of a reinforcing material such as ceramic particles, a metal mold used in a molding step of molding the reinforcing material-molded or filled body is installed in a state where the reinforcing material-molded or filled body molded is put therein, in an outer shell metal mold for molding a composite material to also use when the pores of the reinforcing material-molded or filled body are impregnated or filled with the molten matrix material.

BACKGROUND ART

A metal matrix composite containing, for example: a metal, such as aluminum or an aluminum alloy, as a matrix material; and, as a reinforcing material, ceramic particles, graphite particles, metal particles different from the matrix material, and the like has excellent properties, such as excellent specific strength, specific rigidity, and thermal properties, as compared to the matrix material. Therefore, metal matrix composites are utilized in various industrial fields.

Examples of the method for producing a metal matrix composite include a first production method as described below. In the first production method, a porous reinforcing material-molded body is molded in advance using a mold (metal mold A) for molding a reinforcing material; the resultant reinforcing material-molded body is taken out from the metal mold A; the reinforcing material-molded body is preheated; thereafter the reinforcing material-molded body is installed in another metal mold B for casting to perform casting using a molten matrix material (molten metal); and thus pores (voids) of the reinforcing material-molded body are impregnated or filled to form a compound.

To produce a metal matrix composite which is a raw material for a product and which has a near-net shape of high dimensional accuracy in producing a desired product by the above-described first production method, a reinforcing material-molded body prepared using a metal mold A needs to be inserted, installed and cast in the recessed portion of a metal mold B which has nearly the same size and shape as the reinforcing material-molded body and which is a metal mold for casting. However, it is extremely difficult to insert and fit the reinforcing material-molded body into the recessed portion of the mold for casting when a near-net shape of higher dimensional accuracy is targeted, and there is a problem that breakage and defects of the reinforcing material-molded body occur at the stage of the insertion step. To countermeasure the problem, it is conceivable to provide clearance (gap) at the fitting surface between the reinforcing material-molded body and the metal mold for the purpose of making the insertion and fitting easier. However, when the clearance is provided, a metal matrix composite to be produced is no longer one having highly accurate near-net shape.

In addition, to make the impregnation of the inside of the reinforcing material-molded body with a molten metal (matrix material) and the penetration of the molten metal (matrix material) into the inside of the reinforcing material-molded body better during casting in the above-described first production method, the reinforcing material-molded body and the metal mold for casting need to be preheated to increase the temperature. In general, however, ceramics, graphite, and the like, which are used as a reinforcing material, have a small coefficient of thermal expansion, and on the other hand, the metal mold for casting has a large coefficient of thermal expansion, and therefore there is a need to consider the difference in the amount of thermal expansion due to the above-described preheating, which makes it further difficult to insert and fit the reinforcing material-molded body into the metal mold for casting. Thus, a metal matrix composite having a near-net shape of high dimensional accuracy cannot be cast by the above-described first production method. For such a reason, when a metal matrix composite having almost the same shape as in a final product, in other words having a near-net shape of high dimensional accuracy, is produced by the above-described first production method, a metal matrix composite having a somewhat larger and rough shape needs to be cut so as to form a final shape. However, the metal matrix composite is hard, and therefore there is a problem that by such cutting, processing is difficult and requires time, making costs significantly high.

To counter measure the above-described problem, there has been proposed the following second method for producing a metal matrix composite. In the second production method, particles or short fibers of a reinforcing material are dispersed in a matrix material to prepare, in advance, a reinforcing material-dispersed matrix composite material in which the reinforcing material is dispersed; the resultant reinforcing material-dispersed matrix composite material is melted; and the molten reinforcing material-dispersed composite material is filled in a metal mold for casting, in which the recessed portion of the metal mold is made into a precise near-net shape, by a casting method, such as a die cast, to produce a metal matrix composite.

For example, a technique described in Patent Literature 1 relates to the above-described second production method utilizing a matrix material (reinforcing material-dispersed matrix composite) which is prepared in advance and in which a reinforcing material is dispersed. It is stated that according to this technique, a metal matrix composite having a near-net shape that is close to a final shape can be produced. It is considered that by the second production method, the reinforcing material-dispersed matrix composite which is prepared in advance and in which the reinforcing material is dispersed is utilized, and the reinforcing material-dispersed matrix composite in a molten state can be filled in the recessed portion of the metal mold having a near-net shape of high dimensional accuracy, which therefore enables near-net molding that gives the size equal to the metal mold.

CITATION LIST

Patent Literature

Patent Literature 1: Japanese Patent Laid-Open No. H10-180434.

SUMMARY OF INVENTION

Technical Problem

However, according to studies conducted by the present inventors, there is a problem that the fluidity of the reinforcing material-dispersed matrix composite in a molten state is poor unless the reinforcing material volume ratio (Vf %) of the reinforcing material is low. When a reinforcing material-dispersed matrix composite having a high reinforcing material volume ratio Vf % is used, there occurs a problem such that the reinforcing material-dispersed matrix composite cannot be filled properly in the recessed portion of the metal mold to cause filling failure due to misrun of a molten metal or to make near-net shaping impossible in a thin wall part. Therefore, in the second production method, there is a problem that a metal matrix composite having a high reinforcing material volume ratio Vf % cannot be produced.

Those described above can also be understood from the description of Examples in Patent Literature 1. That is, the aluminum particle-dispersed aluminum matrix composite utilized in Example 1 has a reinforcing material volume ratio (Vf %) of 20%, and the aluminum particle-dispersed aluminum matrix composite utilized in Example 2 has a reinforcing material volume ratio (Vf %) of 12%, and with these materials, metal matrix composites having a low reinforcing material volume ratio (Vf %) can only be obtained. That is, the above-described technique is not a technique for producing a metal matrix composite having a high reinforcing material volume ratio Vf %.

Accordingly, an object of the present invention is to provide a method for producing a metal matrix composite by which a metal matrix composite having a near-net shape of high dimensional accuracy and having a high reinforcing material volume ratio (Vf %) can easily be produced. An object of the present invention is to suitably provide a simple production method by which a metal matrix composite having a near-net shape and having a reinforcing material volume ratio (Vf %) of more than 40% can easily be produced.

Solution to Problem

The above-described objects are achieved by the following method for producing a metal matrix composite of the present invention.

[1] A method for producing a metal matrix composite, the method being a method for obtaining a metal matrix composite having a near-net shape of high dimensional accuracy and having a high reinforcing material volume ratio (Vf %) by compounding a matrix material that is a pure metal or an alloy, including aluminum or an aluminum alloy, and a reinforcing 1 comprising at least one material selected from the group consisting of ceramic particles, graphite particles, and metal particles, the reinforcing material being different from the matrix material, wherein the method comprises:

a molding step of molding a reinforcing material-molded or filled body, wherein a near-net-shaped reinforcing material-molded or filled body having pores inside thereof is prepared using the reinforcing material;

a preheating step; and a casting step of compounding the matrix material and the reinforcing material, wherein in the molding step, a material comprising the reinforcing material is filled in a metal mold having a near-net-shaped space (recessed portion) formed inside thereof to form a reinforcing material-molded or filled body in the metal mold, in the preheating step, the metal mold having the reinforcing material-molded or filled body formed is preheated, and in the casting step, the preheated metal mold in a state where the reinforcing material-molded or filled body is put therein is installed in an outer shell metal mold for casting a composite, the pores of the reinforcing material-molded or filled body in the metal mold are impregnated or filled with the molten matrix material, and in a series of the steps of the molding step of molding reinforcing material-molded or filled body, the preheating step, and the casting step, the same metal mold is used in common.

Preferred embodiments of the method for producing a metal matrix composite of the present invention include the followings.

[2] The method for producing a metal matrix composite according to [1], wherein the reinforcing material volume ratio (Vf %) is more than 40%.

[3] The method for producing a metal matrix composite according to [1] or [2], wherein in the molding step of molding a reinforcing material-molded or filled body, the material comprising at least the reinforcing material is filled in the metal mold having a near-net-shaped space (recessed portion) formed inside thereof, the metal mold in a state where the material is filled therein is used in common, and the material filled in the metal mold that is used in common is subjected to pressurization molding or the metal mold that is used in common is put into a heating furnace to subject the material filled in the metal mold to molding by firing, thereby obtaining the reinforcing material-molded body.

[4] The method for producing a metal matrix composite according to any one of [1] to [3], wherein in the casting step, casting is performed using a pressurizing indenter and applying a casting pressure of 80 MPa to 120 MPa.

[5] The method for producing a metal matrix composite according to any one of [1] to [4], wherein the reinforcing material is at least any of aluminum borate particles, silicon carbide particles, alumina particles, SiC particles, graphite particles, Si particles, and $Al_3Ni$ particles.

Advantageous Effects of Invention

The present invention realizes a method for producing a metal matrix composite by which a metal matrix composite having a near-net shape of high dimensional accuracy and having a high reinforcing material volume ratio Vf % can easily be obtained. A preferred embodiment of the present invention makes it possible to provide a metal matrix composite having a near-net shape of high dimensional accuracy and having a high reinforcing material volume ratio (Vf %) of more than 40% by a simple production method. The present invention provides a novel production method that has never been disclosed in the past, and in the production method, casting is performed by installing, in an outer shell metal mold for casting a composite, a metal mold which is used in molding a reinforcing material-molded or filled body and in which the recessed portion has a near-net shape, in a state where the reinforcing material-molded or filled body is put therein, and therefore all of a series of the steps from preparation of the reinforcing material-molded or filled body to casting by use of a molten matrix material and compounding the reinforcing material and the matrix material can be performed using the same metal mold (using the same metal mold in common) consecutively. The production method of the present invention has an advantage in operation in that: the reinforcing material-molded or filled body does not have to be taken out from the metal mold after the reinforcing material-molded or filled body is molded, which does not require an operation to be done carefully. Further, according to the production method of the present invention, the following remarkable effect is obtained. In conventional techniques, during an operation of taking out the reinforcing material-molded or filled body prepared from the metal mold, or during an operation of installing the taken-out reinforcing material-molded or filled body in the metal mold for casting, as shown in FIG. 3, breakage or deficiencies of the reinforcing material-molded or filled body prepared may occur. In contrast, in the technique of the present invention, the above-described operations themselves are not necessary, and therefore breakage or deficiencies never occur. Therefore, according to the technique of the present invention, a metal matrix composite having a near-net shape of high dimensional accuracy can be obtained with high yield and economically, so that the method for producing a metal matrix composite of the present invention is extremely industrially useful.

BRIEF DESCRIPTION OF DRAWINGS

FIG. 1A is a schematic diagram for explaining a metal mold 1 in the initial state, wherein the metal mold 1 is used in a molding step of molding a reinforcing material-molded or filled body in a method for producing a metal matrix compound of the present invention; in the metal mold 1, the recessed portion is formed into a near-net shape; and the metal mold 1 is to be used in common in the subsequent steps.

FIG. 1B is a schematic diagram for explaining a combined-use metal mold 3 filled with a reinforcing material, wherein the reinforcing material is filled in the recessed portion of the metal mold 1 shown in FIG. 1A.

FIG. 1C is a schematic diagram for explaining a state where the combined-use metal mold 3 filled with the reinforcing material, shown in FIG. 1B, is put in a heating furnace 10.

FIG. 1D is a schematic diagram for explaining a state where the preheated combined-use metal mold 3 filled with the reinforcing material and taken out from the preheating furnace 10 shown in FIG. 1C is put in an outer shell metal mold 20 and 20' for casting a composite.

FIG. 2A is a schematic diagram for explaining a state where a molten matrix material 4 has been poured after the near-net shaped, combined-use metal mold in a state where the reinforcing material-molded or filled body is put in the recessed portion of the metal mold shown in FIG. 1D is installed in the outer shell metal mold 20 and 20' for casting a composite in the method for producing a metal matrix composite of the present invention.

FIG. 2B is a schematic diagram for explaining a state where a pressurizing indenter 30 is descended to start pressurization after pouring the molten matrix material 4 shown in FIG. 2A.

FIG. 2C is a schematic diagram for explaining a casting step of increasing casting pressure using the pressurizing indenter 30 shown in FIG. 2B to compound the reinforcing material-molded or filled body and the matrix material.

FIG. 3A is a schematic diagram for explaining one of the problems in the conventional methods for producing a metal matrix composite, the schematic diagram showing that a taken-out molded body composed of a reinforcing material 2 and prepared using another metal mold needs to be inserted into a metal mold 20" in which the space (recessed portion) has a near-net shape with the molded body.

FIG. 3B is a schematic diagram for explaining a state where the molded body composed of the reinforcing material 2 and taken out from the metal mold is inserted and housed in the metal mold 20", in which the inner space (recessed portion) has a near-net shape with the molded body, for the purpose of performing a casting step using the molten matrix material.

DESCRIPTION OF EMBODIMENTS

Hereinafter, the present invention will be described with reference to preferred embodiments, but the present invention is not limited to these embodiments. The characteristic of a method for producing a metal matrix composite of the present invention is in that a metal mold which is used in preparing a reinforcing material-molded body and in which the space (recessed portion) has a near-net shape with the metal matrix composite to be produced is used in a state where the reinforcing material-molded or filled body formed by the metal mold is put therein in a series of steps to casting of compounding with a molten matrix so that the same metal mold in which the recessed portion has a near-net shape is used in common in each step. Due to such constitution, a reinforcing material-molded body does not have to be taken out from the metal mold for molding, and a taken-out reinforcing material-molded body does not have to be inserted and installed in a metal mold for casting in which the recessed portion has a near-net shape (see, FIG. 3A and FIG. 3B), which are necessary in conventional production methods, and therefore the problem of breakage and deficiencies of a reinforcing material-molded body, which occurs during these operations is solved.

That is, the method for producing a metal matrix composite of the present invention is a production method for easily obtaining a metal matrix composite having a near-net shape of high dimensional accuracy and having a high reinforcing material volume ratio (Vf %) by compounding a matrix material that is a pure metal or an alloy, such as aluminum or an aluminum alloy, and a reinforcing material containing at least one material selected from the group consisting of ceramic particles, graphite particles, and metal particles, the reinforcing material being different from the matrix material. The procedures are as follows. Firstly, in a molding step of molding a reinforcing material-molded or filled body, wherein a near-net-shaped reinforcing material-molded or filled body having pores inside thereof is prepared using the reinforcing material, a material containing the reinforcing material is filled in a metal mold having a near-net-shaped space (recessed portion) formed inside thereof to form a reinforcing material-molded or filled body in the metal mold. Next, in a preheating step, the metal mold having, inside thereof, the reinforcing material-molded or filled body formed is preheated. Further, performed is a casting step of compounding the matrix material and the reinforcing material, wherein the preheated metal mold in a state where the reinforcing material-molded or filled body is put therein is installed in an outer shell metal mold for casting a composite, the pores of the reinforcing material-molded or filled body in the metal mold are impregnated or filled with the molten matrix material. As just described above, the production method of the present invention is characterized in that a series of steps of the molding step of molding a reinforcing material-molded or filled body, the preheating step, and the casting step, which are described above, are performed using the same metal mold having a near-net-shaped space (recessed portion) formed inside thereof in common. In the present invention, the metal mold which is used in common in a series of steps of the production method of the present invention and in which the recessed portion has a near-net shape is referred to as a "metal mold that is used in common for molding and casting a reinforcing material", or also simply referred to as a "metal mold that is used in common" or a "combined-use metal mold."

Hereinafter, the method for producing a metal matrix composite of the present invention will be described with reference to FIG. 1 and FIG. 2. Reference numeral 1 or 3 in FIG. 1 and FIG. 2 is a metal mold that characterizes the present invention and that is used in common in a series of the molding step of molding a reinforcing material-molded or filled body, the preheating step, and the casting step. As schematically shown in FIG. 1A, the space (recessed portion) of the metal mold 1 that is used in common has a near-net shape formed into a desired shape that is almost the same as the shape of a product to be produced using a composite. Reference numeral 2 in FIG. 1 and FIG. 2 denotes a material that is for forming the reinforcing material-molded or filled body and that contains at least a reinforcing material selected from the group consisting of ceramic particles, graphite particles, and metal particles. Further, reference numeral 3 shown in FIGS. 1B to 1D and FIGS. 2A to 2C indicates a state in which the material 2 containing a reinforcing material is put (filled) in the recessed portion of the metal mold 1 that is used in common. This metal mold in a state where the reinforcing material is filled therein is referred to as a "combined-use metal mold 3 filled with a reinforcing material" in the present invention.

Reference numeral 10 in FIG. 1C denotes a heating furnace. In the present invention, when the material 2, which contains a reinforcing material and which is put (filled) in the metal mold 1 that is used in common, is molded by firing as necessary, or when the reinforcing material-molded or filled body obtained in the molding step is preheated, the combined-use metal mold 3 filled with the reinforcing material is disposed in the heating furnace 10, as shown in FIG. 1C, to perform firing or preheating. In the production method of the present invention, the metal mold 1 is used in common in a series of steps in the case of obtaining the reinforcing material-filled body or in the case of subjecting the reinforcing material to pressurization molding or molding by firing to obtain the reinforcing material-molded or filled body, and further, as shown in FIG. 1D and FIG. 2, in the case of performing the casting step of compounding the reinforcing material-molded or filled body formed and the matrix material. In the casting step, the combined-use metal mold 3 filled with the reinforcing material is installed in the outer shell metal mold 20 and 20' for casting a composite, as shown in FIG. 1D, and subsequently casting is performed in this state, as shown in FIGS. 2A to 2C. As just described above, the production method of the present invention is characterized in that all of a series of the production steps are performed using, in common, the same metal mold having a near-net-shaped space (recessed portion) formed inside thereof. The outer shell metal mold for casting a composite, shown in each schematic diagram in FIG. 1D and FIGS. 2A to 2C is composed of an outer shell metal mold 20 that forms a side wall and a lower metal mold 20' for casting that forms a bottom surface of the metal mold in combination. When casting is performed, the combined-use metal mold 3 filled with the reinforcing material is installed in the recessed portion of the outer shell metal mold for casting a composite, and casting is performed as shown in FIGS. 2A to 2C for example, to compound the reinforcing material and the matrix material.

As shown in FIGS. 1A to 1D, in the method for producing a metal matrix composite of the present invention, the material 2 containing a reinforcing material is first put into the recessed portion of the metal mold 1 that is used in common in a series of the steps to form the reinforcing material-molded or filled body having a high reinforcing material volume ratio (Vf %) of, for example, a reinforcing material volume ratio (Vf %) of more than 40%. As the molding step of molding a reinforcing material-molded or filled body, which forms the present invention, various conventionally known methods are applicable. Specific examples thereof include the following methods: a method for obtaining the reinforcing material-filled body, wherein the reinforcing material, such as ceramic particles, is put into the recessed portion of the metal mold 1 that is used in common, and the reinforcing material is vibrated together with the metal mold with a vibrator to fill the reinforcing material 2 so as to have desired high Vf %; and a method for obtaining the reinforcing material-molded body, wherein the reinforcing material is filled in the recessed portion of the metal mold 1, and then pressurization molding is performed by a conventionally known method. In addition, the following method can also be utilized: that is, the method is a method for forming the reinforcing material-molded body in the recessed portion of the metal mold 1, wherein a slurry designed such that a resultant reinforcing material-molded body has desired high Vf % and high strength is prepared by adding raw materials for synthesizing a resin binder to the reinforcing material, such as ceramic particles, and the like by a conventionally known method; and the obtained slurry is filled in the recessed portion of the metal mold 1 to react and solidify the raw materials for synthesizing the resin binder.

Besides, the following is also a preferred embodiment: that is, a slurry designed such that a resultant reinforcing material-molded body has desired high Vf % and high strength is prepared by adding an inorganic binder to the reinforcing material, such as ceramic particles, and the reinforcing material-molded body is obtained using the obtained slurry. Specifically, the following method is also applicable: that is, the method is a method for obtaining the reinforcing material-molded body, wherein the slurry containing an inorganic binder, which is prepared above, is filled in the recessed portion of the metal mold 1, and then the slurry is put into the heating furnace 10 together with the filled metal mold and is subjected to molding by firing and the inorganic binder is thereby reacted and solidified to bond the reinforcing material. At this time, the heating furnace for performing molding by firing and the heating furnace for preheating the reinforcing material-molded body obtained by molding by firing may the same, or different heating furnaces may be used. In any case, a metal mold that is put into the heating furnace in the production method of the present invention is the "combined-use metal mold 3 filled with the reinforcing material" that is in a state where the reinforcing material is filled in the metal mold 1 that is used in common, and the production method of the present invention is characterized in that the reinforcing material is put into the heating furnace 10 together with the metal mold that is used in common.

The production method of the present invention has realized production of a metal matrix composite having a near-net shape of high dimensional accuracy and having a high reinforcing material volume ratio (Vf %), wherein the combined-use metal mold 3 filled with the reinforcing material is obtained in the manner as described above; then the combined-use metal mold 3 filled with the reinforcing material is installed in the outer shell metal mold 20 and 20' for casting a composite; and casting is performed using the molten matrix material. When the combined-use metal mold 3 filled with the reinforcing material after the preheating step is installed in the outer shell metal mold 20 for casting a composite, the outer shell metal mold 20 and 20' is preferably preheated in order to avoid heat shock. In addition, in order to impregnate and fill the pores of the reinforcing material-molded or filled body formed in the metal mold with the molten matrix material in a favorable state, casting is preferably performed using a pressurizing indenter 30 and descending the pressurizing indenter, as shown in FIGS. 2A to 2C, to apply pressure by a casting pressure of, for example, about 80 MPa to about 120 MPa.

EXAMPLES

Hereinafter, the present invention will be described giving Examples, but the present invention is not limited to the following Examples.

Example 1

In this Example, 1.0 kg of aluminum borate particles having an average particle size of 44 μm were used as the reinforcing material. The aluminum borate particles as the reinforcing material were filled in a metal mold that is used in common for molding and casting a reinforcing material, and the combined-use metal mold was installed on a vibrator to apply vibration for 20 minutes to fill the aluminum borate particles in the metal mold such that the filling rate of the aluminum borate particles was more than 40%. As the above-used metal mold that is used in common for molding and casting a reinforcing material, a metal mold having, inside thereof, a desired, near-net-shaped space (recessed portion) having almost the same shape as that of a product composed of a metal matrix composite was used.

The metal mold that is used in common for molding and casting a reinforcing material, the metal mold obtained by filling the aluminum borate particles in the manner as described above and having, inside thereof, the reinforcing material-molded body, was directly put into a heating furnace and preheated to 700° C. in a nitrogen atmosphere. Then, the reinforcing material-molded body was installed together with the preheated combined-use metal mold having the reinforcing material-molded body inside thereof in an outer shell metal mold for casting a composite, the outer shell metal mold preheated to 200° C.

Quickly after that, a molten Al alloy (AC4C) melted at 800° C. was poured into the outer shell metal mold for casting a composite, a pressurizing indenter was descended to increase the casting pressure to 100 MPa, the pressure was held for 10 minutes, and thus a metal matrix composite having a near-net shape was molded. The obtained metal matrix composite was confirmed to be one having a favorable near-net shape that was almost the same shape as the desired shape of a product and was free of breakage and deficiencies.

Example 2

In this Example, 2.0 kg of SiC particles having an average particle size of 20 μm were used as the reinforcing material. As the metal mold that is used in common for molding and casting a reinforcing material, a metal mold having, inside thereof, a desired, near-net-shaped space (recessed portion) having almost the same shape as that of a product composed of a metal matrix composite was used as in Example 1. The SiC particles as the reinforcing material were filled in the combined-use metal mold and was installed together with the combined-use metal mold in a small-sized press machine to perform pressurization molding at 10 MPa, and thus a reinforcing material-molded body in which the filling rate of the SiC particles was 50% was obtained.

Next, the reinforcing material-molded body housed inside the combined-use metal mold was preheated to 800° C. in a nitrogen atmosphere, and then the preheated reinforcing material-molded body was installed together with the combined-use metal mold in an outer shell metal mold for casting a composite, the outer shell metal mold preheated to 250° C. Then, quickly after the installation, a molten Al alloy (ADC12) melted at 800° C. was poured into the outer shell metal mold for casting a composite, a pressurizing indenter was descended to increase the casting pressure to 80 MPa, the pressure was held for 15 minutes to form a composite, and thus a metal matrix composite having a near-net shape was molded. The obtained metal matrix composite was confirmed to be one having a favorable near-net shape that was almost the same shape as the desired shape of a product and was free of breakage and deficiencies.

Example 3

In this Example, 1.0 kg of aluminum borate particles having an average particle size of 44 μm were used as the reinforcing material. To the aluminum borate particles as the reinforcing material, a resin monomer, a crosslinker, and a dispersant were added as raw materials for a binder in an amount of 500 g in total and further, 5 kg of water was added to prepare a slurry in which these raw materials were dispersed. A polymerization initiator was added to the obtained slurry, and then the resultant mixture was filled in a metal mold that is used in common for molding and casting a reinforcing material. The metal mold was left to stand at normal temperature to polymerize the resin monomer and the crosslinker to prepare a resin binder, and thus a reinforcing material-molded body in which the filling rate of the aluminum borate particles was 60% was prepared.

Next, the reinforcing material-molded body housed inside the combined-use metal mold was heated to 700° C. in a nitrogen atmosphere to remove the resin binder. Then, the heated reinforcing material-molded body was installed together with the combined-use metal mold in an outer shell metal mold for casting a composite preheated to 200° C. Then, quickly after the installation, a molten Al alloy (AC4C) melted at 750° C. was poured into the outer shell metal mold for casting a composite, a pressurizing indenter was descended to increase the casting pressure to 100 MPa, the pressure was held for 10 minutes to form a composite, and thus a metal matrix composite having a near-net shape was molded. The obtained metal matrix composite was confirmed to be one having a favorable near-net shape that was almost the same shape as the desired shape of a product and was free of breakage and deficiencies.

Example 4

In this Example, 1.0 kg of scale-like graphite particles having an average particle size of 50 μm were used as the reinforcing material. The scale-like graphite particles as the reinforcing material were filled in a metal mold that is used in common for molding and casting a reinforcing material and installed together with the combined-use metal mold in a small-sized press machine to subject the filled material in the combined-use metal mold to pressurization molding at 20 MPa, and thus a reinforcing material-molded body in which the filling rate of the scale-like graphite particles was 55% was prepared.

Thereafter, the reinforcing material-molded body which was in a state of being housed in the metal mold that is used in common for molding and casting a reinforcing material was preheated to 700° C. in a nitrogen atmosphere, and then the preheated reinforcing material-molded body was installed together with the combined-use metal mold in an outer shell metal mold for casting a composite, the outer shell metal mold preheated to 200° C. Then, quickly after the installation, a molten Al alloy (AC8A) melted at 800° C. was poured into the outer shell metal mold for casting a composite, a pressurizing indenter was descended to increase the casting pressure to 100 MPa, the pressure was held for 10 minutes to form a composite, and thus a metal matrix composite having a near-net shape was molded. The obtained metal matrix composite was confirmed to be one having a favorable near-net shape that was almost the same shape as the desired shape of a product and was free of breakage and deficiencies.

REFERENCE SIGNS LIST

1 Metal mold that is used in common for molding and casting reinforcing material
2 Reinforcing material
3 Combined-use metal mold filled with reinforcing material
4 Matrix material
10 Heating furnace
20, 20', 20" Outer shell metal mold for casting composite
30 Pressurizing indenter

The invention claimed is:

1. A method for producing a metal matrix composite having a near-net shape, the method comprising:

molding a reinforcing material-molded or filled body having a near-net shape of the metal matrix composite and pores, in a metal mold having a cavity therein that corresponds to the near-net shape of the metal matrix composite, with a reinforcing material, the reinforcing material comprising at least one material selected from the group consisting of ceramic particles, graphite particles, and metal particles, thereby forming a combined-use metal mold including the reinforcing material-molded or filled body;

pre-heating the combined-use metal mold including the reinforcing material-molded or filled body;

placing the pre-heated combined-use metal mold including the reinforcing material-molded or filled body in an outer shell metal mold; and casting a matrix material and the reinforcing material by filling a molten matrix material into the pores of the reinforcing material-molded or filled body that is placed in the combined-use metal mold having a near-net shape and being placed in the outer shell metal mold, thereby obtaining the metal matrix composite as a resulting casted product, wherein the cavity of the mold having the near-net shape has a substantially same shape as a shape of the casted product, the molten matrix material being a pure metal or an alloy and being different from the reinforcing material, wherein the pure metal is aluminum and the alloy is an aluminum alloy, wherein the metal mold having a near-net shape used in the molding of the reinforcing material-molded or filled body is further used as the combined-use metal mold, in the pre-heating, the placing, and the casting in the method.

2. The method for producing a metal matrix composite according to claim 1, wherein the metal matrix composite has a reinforcing material volume ratio (Vf %) in a range of more than 40%.

3. The method for producing a metal matrix composite according to claim 1, wherein in the molding of the reinforcing material-molded or filled body, the metal mold is pressurized, or is put into a heating furnace so as to fire the reinforcing material filled in the metal mold, thereby obtaining the reinforcing material-molded body in the combined-use metal mold.

4. The method for producing a metal matrix composite according to claim 1, wherein the casting is performed by using a pressurizing indenter and applying a casting pressure in a range from 80 MPa to 120 MPa.

5. The method for producing a metal matrix composite according to claim 1, wherein the reinforcing material is at least one material selected from the group consisting of aluminum borate particles, silicon carbide particles, alumina particles, graphite particles, Si particles, and $Al_3Ni$ particles.

6. The method for producing a metal matrix composite according to claim 1, wherein the metal matrix composite has a reinforcing material volume ratio (Vf %) in a range of 50% or more.

* * * * *